United States Patent [19]

Barbee et al.

[11] Patent Number: 4,771,277

[45] Date of Patent: Sep. 13, 1988

[54] MODULAR TOUCH SENSITIVE DATA INPUT DEVICE

[76] Inventors: Peter F. Barbee, 5219 Kensington Pl. N., Seattle, Wash. 98103; Jack L. Galloway, 5302 152nd St. SW., Edmonds, Wash. 98020

[21] Appl. No.: 860,287

[22] Filed: May 2, 1986

[51] Int. Cl.[4] ..... H01H 9/08

[52] U.S. Cl. ..... 340/712; 200/159 B

[58] Field of Search ..... 340/712, 706, 711, 365 R; 178/18, 19, 17 C; 358/245, 246, 247, 252, 255, 254; 200/159 B, 5 A, 293; 361/395; 312/214, 257 A; 206/454, 455, 456

[56] References Cited

U.S. PATENT DOCUMENTS

| | | | |
|---|---|---|---|
| 3,164,672 | 1/1965 | Spear et al. | 358/247 |
| 3,952,152 | 4/1976 | Lill et al. | 358/245 |
| 4,063,289 | 12/1977 | Vecnendaal | 358/247 |
| 4,246,613 | 1/1981 | Choder et al. | 358/245 |
| 4,300,029 | 11/1981 | Maser | 200/159 B |
| 4,317,012 | 2/1982 | Itoh | 200/5 A |
| 4,354,205 | 10/1982 | Lowe et al. | 358/253 |
| 4,415,983 | 11/1983 | Lachmann et al. | 361/395 |
| 4,427,861 | 1/1984 | Stellie | 340/365 VL |

FOREIGN PATENT DOCUMENTS

| | | | |
|---|---|---|---|
| 0020528 | 2/1980 | Japan | 340/712 |
| 0121880 | 7/1983 | Japan | 358/254 |
| 2033632 | 5/1980 | United Kingdom | 340/706 |

OTHER PUBLICATIONS

G. G. Promis et al., "Control Panel", IBM Technical Disclosure Bulletin, vol. 19, No. 2, July 1976, pp. 405–406.

"Product Design and Process Engineering", Niebel et al., McGraw-Hill, 1974, p. 744.

*Primary Examiner*—John W. Caldwell, Sr.
*Assistant Examiner*—Alvin Oberley

[57] ABSTRACT

A touch sensitive data input device is provided for use with the screen of a cathode ray tube. The device has an annular bezel that loosely supports a firm clear backing plate. A rear transparent sheet element that has a coefficient of thermal expansion different from that of the backing plate is loosely retained against the backing plate to avoid deformation induced by differential thermal expansions. A closely spaced apart front transparent element is placed adjacent the rear transparent sheet, their respective adjacent surfaces having mutually orthogonal electrically conductive strips that make local electrical contact when a force is applied to the front element. An annular frame over the front element is secured to the bezel. In one aspect of the invention, a gasket with both sides coated with a resilient bonding material seals the frame to the bezel to protect the zone between the transparent front and rear elements from contamination by environmental pollutants.

20 Claims, 2 Drawing Sheets

MODULAR TOUCH SENSITIVE DATA INPUT DEVICE

TECHNICAL FIELD

This invention relates generally to a touch sensitive data input device mounted to the face of a CRT and, more particularly, to such an input device that is environmentally sealed and insensitive to ambient temperature variations.

BACKGROUND ART

Computer technology has expanded rapidly in recent times and in this country millions of individuals now have ready access to computer terminals through which they can communicate with data networks. A very large portion of actual computer use involves the user accessing, manipulating, updating, or utilizing massive amounts of data in real time. In the vast majority of cases, the user has relatively limited knowledge or understanding of the complex programs and hardware system, and most users find it most convenient to manipulate the data in highly visible form.

Among the mechanisms by which a computer user can call up data, change display modes and make changes to the displayed data are keyboards, light pens, small hand-operated devices known generally by the term "mouse" and, most recently, touch sensitive screens or panels.

In principle, touch sensitive data input devices are obtainable in a variety of forms, and may operate by any of a variety of mechanisms. These include devices wherein, typically, the touch of a user's finger at a point on a touch sensitive surface causes interruption of light beam arrays, change in local capacitance, change in local resistivity by piezoelectric effect, and by contact between adjacent closely-spaced electrical conductors aligned in mutually orthogonal directions.

Successful embodiments of the last mentioned approach typically comprise two flexible membrane-like elements disposed in face-to-face relationship and separated from each other by a slight air gap. The elements typically are optically clear flexible polymeric sheet-like elements which are normally separated by small bumps on one or the other of the adjacent surfaces. A clear stiff backing panel, e.g., a glass sheet, is located behind the rear element to provide support when a user applies force to the front surface of the front element during use of the device. An operator pressing on the outer one of the elements will cause both elements to touch locally, to form a local contact area which can be detected by sensitive circuitry connected to thin, narrow, highly conductive layers disposed on the two adjacent contactable surfaces and connected to the computer system. Electrical current flow at a local contact point is translated into the location of the contacting conductors on the screen. Such spatial discrimination and the resultant signals can be utilized with a computer program for the manipulation of data visibly displayed through the two optically clear adjacent and contactable elements.

A major problem in manufacturing such a device from the most suitable materials is that due to ambient temperature changes in use the stiff transparent backing plate expands or contracts at a significantly different rate then either the material surrounding it or the clear flexible front and rear elements that it supports itself. This differential expansion can cause deformation, e.g, bending of the backing plate, wrinkling of the flexible elements and the like, and prevent adequate sealing against dust, moisture and other pollutants that may get into the sensitive zone between the flexible elements.

Accordingly, a need exists for a touch sensitive data input device that accomodates differential thermal expansion between adjacent coacting elements, provides effective sealing against pollutants in the environment and is readily attached to the data display unit with which it is used.

DISCLOSURE OF THE INVENTION

It is an objective of this invention to provide a touch sensitive data input device which accommodates the different amounts of thermal expansion and contraction experienced by its coacting elements due to ambient temperature changes, without deleterious deformations thereof.

It is another objective of this invention to provide a touch sensitive data input device which accomodates the different amounts of thermal expansion and contraction experienced by its coacting elements due to ambient temperature changes, without deleterious deformations, while also maintaining effective sealing-out of environmental pollutants such as dust, moisture and airborne chemicals from sensitive portions thereof.

It is yet another objective of this invention to provide a self-contained, temperature-insensitive, environmentally-sealed, touch-sensitive data input device that is releasably attachable to a data display device for use therewith.

These and other advantages of the present invention are realized in the preferred embodiment of this invention in a touch sensitive data input device that has an annular bezel member with a central aperture through which is exposed the screen of a CRT to which the device is releasably attached. The front of the bezel, around the aperture in it, is formed as a wall to which is loosely mounted a firm clear backing plate. A rear transparent sheet element is located with its rear surface adjacent the front of the backing plate and on its front surface has a plurality of parallel electrically conductive first strips. The backing panel and the rear sheet element have different coefficients of expansion, hence they are only loosely retained against each other to avoid wrinkling of the rear sheet element due to differential thermal expansions between them. A front transparent sheet element is located closely spaced-apart from and in front of the rear sheet element. The front sheet element has on its rear surface a plurality of parallel electrically conductive second strips orthogonal to the first strips on the front of the rear sheet element. The front and rear sheet elements can be made to contact locally by a force applied to the front sheet element, whereby an electrical connection is made between particular ones of the first and second conductive strips at the point of contact. A frame located over the front sheet element is secured to the bezel to hold the sheet elements in place.

Still other objects and advantages of the present invention will become readily apparent to those skilled in this art from the following detailed description, wherein only the preferred embodiment of the invention is shown and described, simply by way of illustration of the best mode contemplated of carrying out this invention. As will be realized, the invention is capable of other and different embodiments, and its several details are capable of modifications in various obvious respects, all without departing from the invention. Accordingly, the drawings and description are to be regarded as illustrative in nature, and not as restrictive.

BEST MODE FOR PRACTISING THE INVENTION

The touch sensitive data input device according to a preferred embodiment of this invention is constituted of elements that are shaped and sized to conveniently fit together into a compact, rugged and environmentally sealed assembly that accomodates differential thermal expansion of its coacting elements and ensures that environmental pollutants, e.g., dust, moisture and airborne chemicals, do not enter its sensitive zones.

The vast majority of data display elements, e.g., computer monitors, have a generally rectangular visually perceptible data field and have a front screen that is either planar or slightly curved. The device of this invention is made of a size and shape suitable for releasable engagement and use with a cathode ray tube of such a display element.

Figure 1:
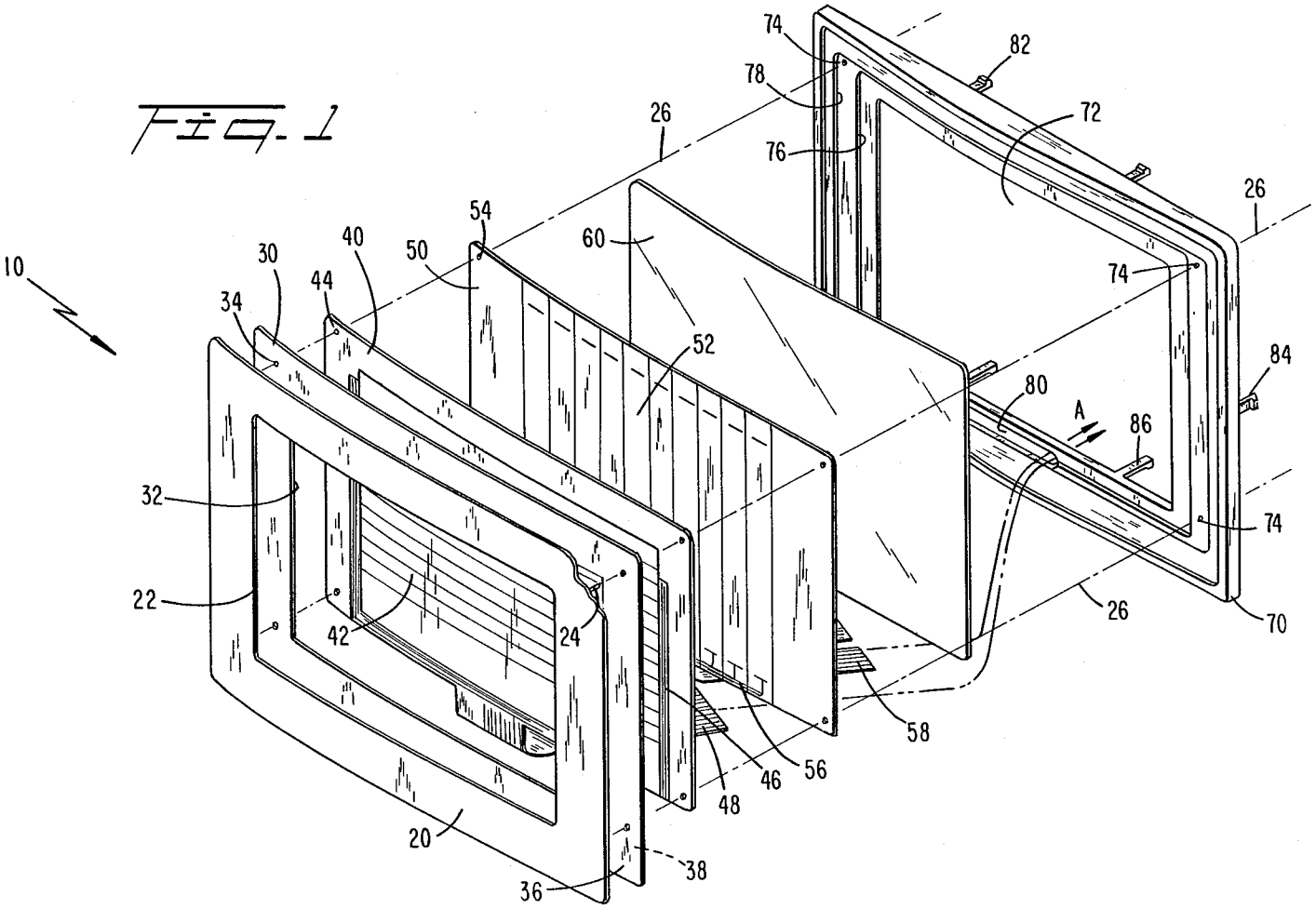
FIG. 1 is an exploded perspective view of the elements of a preferred embodiment of this invention.

Referring now to FIG. 1, a preferred embodiment of the device of this invention is shown in exploded perspective view. For convenience of reference and ready visualization of the interrelating juxtaposition of the different elements of the assembly, the term "front" refers generally to that surface of any element that is visible in the perspective view of FIG. 1 and the term "rear" generally refers to that surface of any of the elements that is on the side opposite the front of the respective elements, i.e., that portion that cannot be viewed in FIG. 1. In this context, the assembly 10 of this device comprises, starting from the front, an annularly formed, preferably rectangular, retainer frame 20. A generally rectangular aperture 22 in retainer frame 20 is shaped and sized to match the data display screen of a data display element (not shown), e.g., a CRT of a data processing system. At the rear face of frame 20 in a preferred embodiment, preferably towards the corners of aperture 22 therein, are short preferably pin-like extensions 24, the function of which is more fully discussed herein below. In the alternative, separate pins can be inserted through the frame 20. Retainer frame 20 is conveniently made of a plastics material and is thin but fairly stiff. A preferred material for frame 20 is a 20% glass-filled moldable polycarbonate material that has a low coefficient of thermal expansion.

Immediately to the rear of frame 20 is a similarly shaped flexible gasket 30 provided with a rectangular aperture 32 to match aperture 22 in retainer frame 20. Gasket 30 is provided with retaining apertures 34 that are disposed to receive the pin-like extensions 24 of retainer frame 20 (or separate pins if the alternative approach is used) therethrough. For convenience of manufacture, apertures 34 may preferably be sized to easily slip around extensions 24 during assembly. Gasket 30 is preferably coated on both its front and rear sides 36 and 39 respectively with a resilient, e.g., elastomeric, adhesive that is effective in a temperature range from −55° C. up to at least 75° C.

Immediately to the rear of gasket 30 is a tough, thin, flexible sheet-like front touch sensitive element 40. Front element 40 is somewhat smaller than frame 20 or gasket 30, but is generally rectangular in shape and is also provided with apertures 44 to match apertures 34 to receive pin-like extensions 24 therethrough. Front element 40 has a touchable front face that is to be contacted by a user repeatedly and frequently during use of the device. The material of front element 40, therefore, must be selected to be one that retains its transparency and does not scratch easily during prolonged use. Front element 40 is preferably made of Mylar TM which is tough, durable, not easily scratched or cut in use, optically transparent, and has a low coefficient of thermal expansion, i.e., it is stable over a wide range of temperatures.

To the rear surface of front element 40, by vacuum deposition or the like, is applied a set of parallel strip-like deposits of an electrically conductive material 42. The thickness of electrically conductive material deposits 42 is generally of the order of a few microns, and a preferred material is gold because it provides for virtually transparent but highly conductive permanent deposits. The set of electrically conductive strips 42 on the rear face of front element 40 is such as to extend completely across aperture 22 in frame 20 and aperture 32 of gasket 30. Each electrically conductive strip 42 is preferably narrow and has electrical contacts at each end which lead to conductive extensions along an extension of the flexible transparent front element 40. These conductive extensions 48 of the conductive elements 42 are best seen in FIG. 1.

Immediately to the rear of front element 40 is a transparent rear touch sensitive element 50, of comparable material, shape and size. Rear element 50 is provided at its front surface with thin electrically conductive deposits disposed in parallel strips 52. Although the conductive deposits 52 are shown orthogonal to conductive deposits 42 in FIG. 1, their disposition need not be so limited. Depending on the particular use of the device, e.g., in connection with a rotational scan, other more convenient dispositions of the sets of electrically conductive strips 42 and 52 may not only be desirable but necessary. Persons skilled in the art of manufacturing such devices will readily be able to develop such conductive deposits and connect them generally as described herein. Note that the vertical set of parallel conductive strips 52 on rear element 50 extend past the vertical dimension of aperture 22 in frame 20 and, like horizontal strips 42 previously discussed, are provided with electrically conductive extensions at their individual ends. These extensions 58 of the conductive parallel strip-like deposits 52 are supported on the front surface of an extension of rear element 50 and are best seen in FIG. 1. It is convenient to have the extensions 48 of the front element 40 and 58 of the rear element 50, respectively, parallel in the final assembly.

Front element 40 is provided with a plurality of receiving apertures 44 and rear element element 50 is provided with a comparable plurality or receiving apertures 54 that match, in their location and disposition, the receiving apertures 34 of gasket 30 and pin-like extensions 24 of retainer frame 20.

The rear surface of front element 40 and the front surface of rear element 50 are normally spaced apart by a very small distance, of the order of a few one-thousanths of an inch, so that the conductive deposits 42 and 52 do not make contact unless an external force is applied to the touchable front face of front element 40 to locally deform it and generate such a contact between the conductive elements 42 and 52. This spacing-apart of the two adjacent conductively covered faces of the front and rear elements is obtainable in a number of ways that are well-known, including the provision of small bumps or protrusions co-extensive with one of the two adjacent surfaces. There are a variety of ways of providing this desired normal but close separation between the active surfaces of the elements and the details of the means by which this is obtained are not central to this invention. One particular technique involves the disposition of small electrically insulating particles between the adjacent conductive active surfaces, as described in U.S. patent application Ser. No. 780,583, filed Sept. 26, 1985, U.S. Pat. No. 4,696,860, assigned to the assignee of this application.

Other and seemingly very different means of generating signals by the application of an external force to a touch sensitive panel assembly are available, and include the interruption of light beam arrays in the close spacing between the front and rear elements, capacitive zones on the adjacent surfaces, fine piezoelectric switches on one or both of the adjacent surfaces, and the like. The choice of one of these techniques affects only the manner in which the elements operate with little, if any, difference in how the device connects with an existing data processing facility. Connection means for each of these techniques are readily available and are believed to be well-known to persons skilled in the art.

Immediately to the rear of rear element 50 is a relatively firm but clear and transparent rectangular backing plate 60. Backing plate 60 preferably has dimensions that make it smaller than the zone defined by the pin-like extensions 24 of retainer frame 20, which extensions 24 pass through receiving apertures 34, 44 and 54. The provision of backing plate 60 as an integral part of the assembly constituting this device sets the device free of the requirement of any direct contact between the touch sensitive elements, by which the user communicates with the data processing system, and a surface of the data display unit, e.g., a data monitor screen. This particular feature makes the device of this invention self-contained and easily detachable from the data display unit to which it is attached during use. Backing plate 60 loosely provides adequate support to rear element 50 without in any way forcing it to stretch, contract or wrinkle due to changes in ambient temperature and, through its front element 40 when the user applies an external force to the touchable front surface of front element 40. A preferred material for backing panel 60 is acrylic plastic, principally because it is very strong (unlike glass), optically transparent, and reasonable in cost. It has the disadvantage, however, of possessing a higher coefficient of thermal expansion than the Mylar TM material of the front and rear elements 40 and 50 or the glass-filled polycarbonate plastic of frame 20. This invention provides a designed solution that fully utilizes the desirable qualities of the acrylic plastic of backing panel 60 while avoiding the problems posed by its high thermal coefficient of expansion. How this is accomplished as described below.

Directly to the rear of backing plate 60 is the front of bezel 70. Bezel 70 is a fairly rigid strong element, also preferably made of a molded glass-filled polycarbonate plastic material, which is provided with a rectangular generally central aperture 72 that matches aperture 22 through retainer plate 20. Aperture 72 preferably matches in shape and size the screen portion of the data display element of the data processing system with which this device is to be used. Immediately surrounding aperture 72 in bezel 70 is a shallow, generally rectangular, recess 76, which is large enough to receive therein backing plate 60 with a generous tolerance or play in both lateral directions. Thus backing panel 60 is allowed room to expand within recess 76 without any restraints. This becomes important with data display units that in themselves, or because of their location, experience a change in temperature during prolonged use. By this provision of a predetermined but adequate tolerance as described herein, backing plate 60 is not distorted due to an attempt by it to expand within the generous space provided within recess 76 of the relatively sturdy bezel 70. The depth of recess 76 is preferably slightly greater than the thickness of backing plate 60. This ensures that backing plate 60 will not wrinkle the rear element 50 adjacent to it. The amount of play in any direction can be readily determined by persons skilled in the art, depending upon the overall size of bezel 70 and backing plate 60. While it should not be excessive, typically of the order of 0.020–0.050 inch for a touch sensitive area about 10 inches long, it should be sufficient to comfortably accommodate any foreseeable differentials in thermal expansion between backing panel 60 and bezel 70.

Immediately surrounding recess 76 is a second recess 78 of bezel 70. Recess 78 is shaped and sized to receive therein the front and rear elements and gasket 30 all of which, as best seen in FIG. 1, have larger lateral dimensions. When these elements are so assembled, the backing plate 60 is loosely sandwiched within recess 76 by the rear surface of rear element 50, and the front and rear elements are themselves contained within recess 78. Recess 78 is also provided with receiving apertures 74 that are disposed to match the locations of pin-like extensions 24 of retaining frame 20 and also receiving apertures 34, 44 and 54 in the respective elements that contain them.

When the device is assembled, therefore, pin-like extensions 24 of retainer frame 20 pass through apertures 34 of gasket 30, then through apertures 44 of the front element 40 and apertures 54 of the rear element 50, outside and past the corners of backing plate 60 and, preferably in an interference fit, through matchingly disposed receiving apertures 74 of bezel 70. The rear peripheral surface of retainer frame 20 preferably continuously contacts the adhesive front surface 36 of gasket 30 while the adhesive rear surface 38 of gasket 30 simultaneously contacts the outer periphery of the somewhat smaller front element 40 (see FIG. 1) and, peripherally outside thereof, the front surface of bezel 70. Bezel 70 is preferably formed to have a ridge to surround retainer frame 20. The adhesive used on both sides of gasket 30 preferably is resilient, e.g., an elastomeric material, that will itself accommodate differential thermal expansions of the adhered surfaces without physically separating therefrom, thus maintaining sealing.

Lines 26 indicate how pin-like extensions 24 of retaining frame 20 move through the respective apertures in the different elements and through bezel 70 so that all the different elements are integrated into a single compact device. Extensions 48 and 58 of the conductive elements of the front and rear elements, 40 and 50 respectively, may conveniently be passed through an aperture 80 in bezel 70, as indicated by arrows A in FIG. 1, and thereafter attached to a suitable connector (not shown) for use with a data processing system.

The benefits obtained from the above-described assembly are significant. First, backing plate 60, which is made of a tough and clear but thermally expansive acrylic plastic, is given room to expand within recess 76 of bezel 70 which is made of a tough but opaque and thermally non-expansive polycarbonate plastic. Second, the frame 20 adhering to the front adhesive surface 36 of gasket 30 provides environmental sealing against dust, moisture and airborne chemical pollutants at the front of the assembly. Third, the bezel 70 adhering to the rear adhesive surface 38 of gasket 30 provides similar environmental sealing around the edges of the adjacent, closely spaced-apart and very sensitive active surfaces of touch sensitive front and rear elements 40 and 50. Because the Mylar TM of elements 40 and 50 has a low coefficient of thermal expansion quite close to that of the glass-filled polycarbonate plastic materials of both retainer frame 30 and bezel 70, there is generally only a relatively small differential expansion between their adjacent surfaces. The use of an elastomeric adhesive on surfaces 36 and 38 of gasket 30 further ensures that such small temperature-induced differential expansions are accommodated without any serious risk of stretching or wrinkling of the Mylar TM or loss of environmental sealing around elements 40 and 50.

It should be noted that pin-like extensions register the front element 40 with respect to rear element 50, i.e., determine the juxtaposition of their conductive surfaces 42 and 52 respectively, both at the initial assembly and subsequently. However, because the adhesive affixation provided by the rear surface 328 of gasket 30 has a much larger physical expanse and affixing effectiveness than do the single, pin-like elements 24, the carefully determined initial registration between front and rear elements 40 and 50 is securely preserved over prolonged use of the device. This is a significant and intended benefit because, during use of the device, various users will undoubtedly apply some transverse force that, otherwise, could laterally displace one or both of front and rear elements 40 and 50 with respect to each other and by stretching of their apertures 44 and 54, respectively, at pin-like elements 24. All of these factors together contribute to and account for the "ruggedness" of the device of this invention., While use of the adhesively coated gasket 30, as describe for a preferred embodiment, is convenient, it is not essential. In other words, an elastomeric adhesive coating applied to the rear surface of frame 20 will serve just as effectively to bond the front surface of front element 40 peripherally around aperture 32 and also enable frame 30 to bond, therearound, to bezel 70.

At the rear of bezel 70 is provided a plurality of finger-like extensions, 82 at the top, 84 at the sides, and 86 at the bottom. The matching protrusions of finger-like elements 82, 84 and 86 are intended to engage matchingly shaped portions of the data display unit to which this device is to be attached for use. Obviously, other forms of such retaining mechanisms may advantageously be employed. The simplicity of such a mechanism also contributes to the ruggedness of the device (during repeated disengagements over time) as well as to the low cost of its manufacture.

Figure 2:
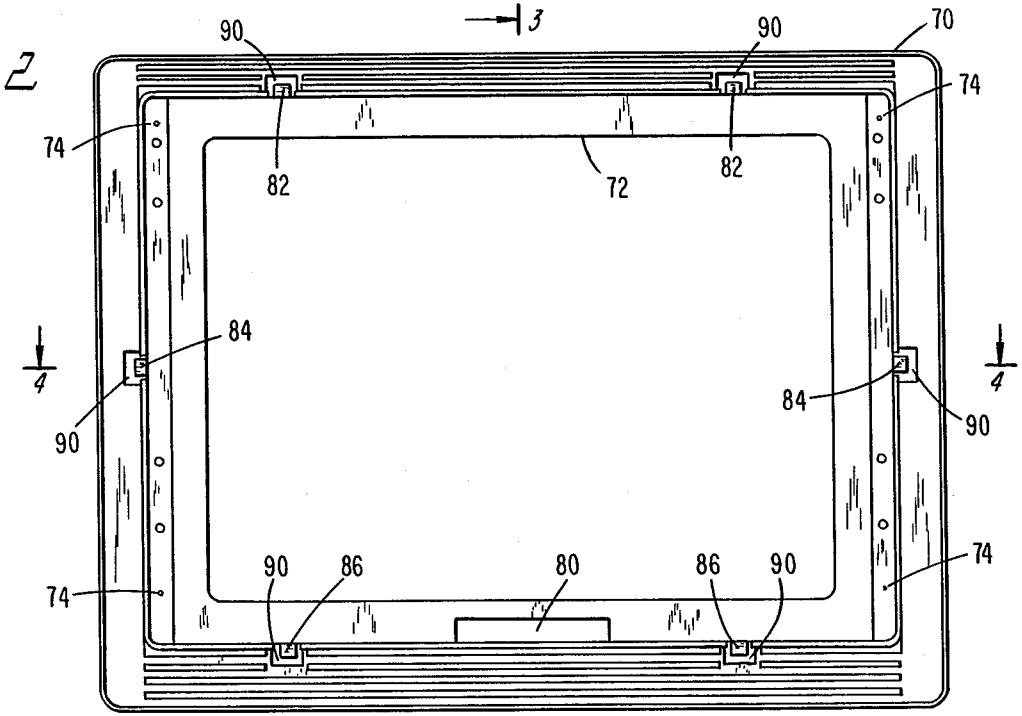
FIG. 2 is a rear elevation view of the bezel element of the assembly comprising a preferred embodiment of this invention.

FIG. 2 is a vertical elevation view, from the rear, of bezel 70. This view shows the disposition of data viewing aperture 72, receiving apertures 74 for receiving pin-like extensions 24 of retaining frame 20, aperture 80 for receiving extensions 48 and 58 of the front and rear elements respectively, and the various finger-like extensions 82, 84, 86 each with an optional reinforcement zone 90 at the bottom thereof.

Figure 3:
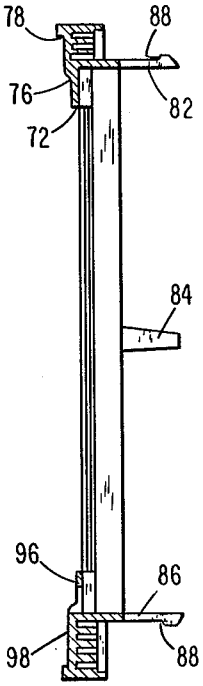
FIG. 3 is a vertical cross-sectional view at section 3—3 of FIG. 2.

The vertical span of viewing aperture 72, recess 76, and recess 78 thereabout is best shown in FIG. 3. Bottom surface 96 of recess 76 contacts the rear surface of backing plate 60. Likewise, the surface 98 of recess 78 contacts the rear surface of rear element 50 and peripherally thereof, the adhesive rear surface 38 of gasket 30.

Figure 4:
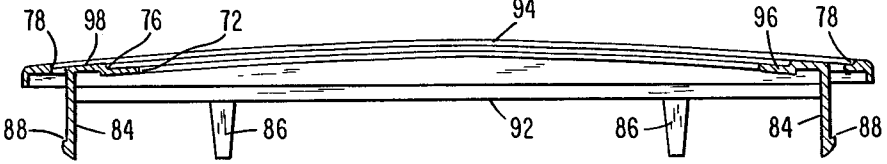
FIG. 4 is a horizontal cross-section view at section 4—4 of FIG. 2.

As mentioned previously, although it is not necessary that backing plate 60 be formed in a curved shape, it is generally most convenient to a viewer to have backing plate 60 held in a slightly curved shape. The particular embodiment of bezel 70, depicted in sectional view in FIG. 4, is one that will provide a slight curvature to backing panel 60 when received in recess 76, and to the front and rear elements 40 and 50 when these are received in recess 78, when these elements are all held in place securely by the insertion of pin-like extensions 24 of retaining frame 20. The adhesion provided peripherally to frame 20 and surface 98 of bezel 70 further ensures security of the front of the assembly in its curved form. Bezel 70 may conveniently have a flat rear surface 92 and a curved front surface 94.

The device according to the preferred embodiment discussed hereinabove is therefore assembled in the order shown in the exploded perspective view of FIG. 1. The addition of a connector (not shown), to connect extensions 48 and 58 of the respective conductive deposits on the adjacent elements 40 and 50 completes the assembly of the device of this invention.

The touch sensitive device according to this invention is self-contained and includes its own backing panel. It is light in weight, compact and portable. It is a rugged device that keeps dust, moisture and pollutants out of its most sensitive zones. A user may easily attach the device to the front of a CRT visual data display element by the latching action of extensions 82, 84 and 86, and connect the device to an appropriate plug-compatible element of the data processing system in order to put the device in condition for use. Visually perceptible data is viewed through transparent backing plate 60 and transparent elements 40 and 50. By applying a force, i.e., by forcibly touching the touchable surface of the front element 40, the user obtains electrical contact between the conductive deposits 42 and 52 of the front and rear elements 40 and 50 respectively. With the conductive elements 42 and 52 connected in an appropriate manner to the data processing system, the location of the application of this force will be determined by measurements of the current and/or voltage flowing through the different contacting conductive elements and, preferably with digitization, be integrated with other data available to the data processing system for manipulation of the data contained or processed therein.

The benefits of touch sensitive data input systems, as distinguished from the relatively more demanding use of a keyboard and detailed instructions to manipulate data, are thus made more readily available by the rugged, compact, temperature insensitive and relatively inexpensive device of this invention. It is expected that persons skilled in the art, upon developing an understanding of the preceding disclosure, will be able to practice this invention otherwise than as specifically described and disclosed herein. Modifications may therefore be made to the specific embodiment disclosed here without departing from the scope of this invention and such modifications are intended to be included within the claims appended below.

What is claimed is:

1. A touch sensitive data input device for the screen of a cathode ray tube (CRT), comprising:

a bezel formed to have a first recess and adapted to be mounted to said screen with said recess exposed and also having an aperture within said first recess through which the screen is exposed;

a transparent backing plate mounted to the bezel within the first recess so as to cover said aperture, the backing plate being smaller than the first recess to thereby establish a small transverse play between the backing plate periphery and a wall defining the recess therearound;

a rear transparent sheet element located against said backing plate such that contact therebetween occurs only between a rear surface of the rear sheet element and an adjacent front surface of the backing plate, a front surface of said rear sheet element containing a plurality of parallel, transparent, electrically conductive first strips said rear sheet element and said backing plate being respectively formed of materials having different thermal coefficients of expansion, said rear sheet element being retained against but not secured to said backing plate to avoid wrinkling of said rear sheet element on said backing plate in response to ambient temperature changes due to differential expansion therebetween because of said different thermal coefficients of expansion of said element and plate;

a front transparent sheet element facing said rear sheet element and containing a plurality of parallel, electrically conductive second strips disposed to be orthogonal to said first strips, said first and second strips being electrically insulated and closely shaped apart from each other until external pressure applied to the front sheet establishes an electrical connection between particular ones of said first and second conductive strips at the point of contact; and a frame located over said front sheet element and secured to said bezel.

2. The device of claim 1, wherein:

the first recess of said bezel has a depth slightly larger than the thickness of said backing plate and contains an inwardly extending retaining lip defining said aperture, said backing plate being supported within said bezel by said lip, such that a clearance corresponding to said small transverse play between said backing plate and said wall is large enough to enable said backing plate to thermally expand within said first recess in said bezel without distortion of said plate whenever the bezel and the backing plate experience temperature changes.

3. The device of claim 1, wherein:

said front sheet element is secured to said frame by a bonding material.

4. The device of claim 3, wherein:

said bonding material is resilient to enable said front sheet element to thermally expand or contract with respect to said frame without breakage of the bond therebetween.

5. The device of claim 1, further comprising:

retaining pins extending between said frame and said bezel.

6. The device of claim 5, wherein:

said pins extend through said front and rear sheet elements.

7. The device of claim 1, wherein:

said bezel is formed with a second recess surrounding said first recess and sai aperture for receiving said front and rear sheet elements.

8. The device of claim 1, further comprising:

tabs extending from said bezel for releasably coupling said bezel to a CRT screen.

9. The device of claim 1, wherein:

said backing plate comprises acrylic plastic material.

10. The device of claim 1, wherein:

said front transparent element comprises Mylar TM.

11. The device of claim 1, wherein:

said rear transparent element comprises Mylar TM.

12. The device of claim 10, wherein:

said rear transparent element comprises Mylar TM.

13. The device of claim 12, wherein:

said backing plate comprises acrylic material.

14. The device of claim 1, wherein:

said frame comprises molded polycarbonate material reinforced with glass fibers.

15. The device of claim 1, wherein:

said bezel comprises molded polycarbonate material reinforced with glass fibers.

16. The device of claim 14, wherein:

said bezel comprises molded polycarbonate material reinforced with glass fibers.

17. The device of claim 13, wherein:

said frame comprises molded polycarbonate material reinforced with glass fibers, and said bezel comprises molded polycarbonate material reinforced with glass fibers.

18. The device of claim 4, further comprising:

an annular gasket coated with said adhesive bonding material on both sides, sealably bonded on its front side to the rear surface of said frame and also sealably bonded to the periphery of the front surface of said front sheet element and, further outside thereof, peripherally bonded to a surface of said bezel, whereby the zone between the closely spaced-apart front and rear sheet elements is sealed to exclude environmental pollutants therefrom.

19. The device of claim 17, wherein:

said front sheet element is secured to said frame by a resilient bonding material to enable said front sheet element to thermally expand or contract with respect to said frame and bezel without breakage of any bonds therebetween.

20. The device of claim 19, further comprising:

an annular gasket coated with said adhesive bonding material on both sides, sealably bonded on its front side to the rear surface of said frame and also sealably bonded to the periphery of the front surface of said front sheet element and, further outside thereof, peripherally bonded to a surface of said bezel, whereby the zone between the closely spaced-apart front and rear sheet elements is sealed to exclude environmental pollutants therefrom.

* * * * *

UNITED STATES PATENT AND TRADEMARK OFFICE

CERTIFICATE OF CORRECTION

PATENT NO. : 4,771,277

DATED : September 13, 1988

INVENTOR(S) : Peter Barbee, Jack L. Galloway

It is certified that error appears in the above-identified patent and that said Letters Patent is hereby corrected as shown below:

Column 9, line 42, Change "shaped" to --spaced--.

Signed and Sealed this

Twenty-seventh Day of November, 1990

*Attest:*

HARRY F. MANBECK, JR.

*Attesting Officer*

*Commissioner of Patents and Trademarks*